US011517121B2

(12) United States Patent
Boyd

(10) Patent No.: US 11,517,121 B2
(45) Date of Patent: Dec. 6, 2022

(54) AIR MATTRESS AND PUMP COMBINATION

(71) Applicant: Dennis M. Boyd, St. Louis, MO (US)

(72) Inventor: Dennis M. Boyd, St. Louis, MO (US)

( * ) Notice: Subject to any disclaimer, the term of this patent is extended or adjusted under 35 U.S.C. 154(b) by 0 days.

(21) Appl. No.: 17/015,517

(22) Filed: Sep. 9, 2020

(65) Prior Publication Data

US 2021/0068555 A1 Mar. 11, 2021

Related U.S. Application Data

(60) Provisional application No. 62/897,606, filed on Sep. 9, 2019.

(51) Int. Cl.
*A47C 27/08* (2006.01)

(52) U.S. Cl.
CPC ..... *A47C 27/082* (2013.01)

(58) Field of Classification Search
CPC ..... A47C 27/082
See application file for complete search history.

(56) References Cited

U.S. PATENT DOCUMENTS 6,287,095 B1 * 9/2001 Saputo ..... A47C 27/081 417/472
2004/0261183 A1 * 12/2004 Tsai ..... F04D 25/084 5/713
2008/0232982 A1 * 9/2008 Boyd ..... F04D 29/503 417/315
2008/0244834 A1 * 10/2008 McClintock ..... A47C 27/082 5/694
2010/0235988 A1 * 9/2010 Pittman ..... A47C 21/048 5/119

FOREIGN PATENT DOCUMENTS

CN 208294737 U * 12/2018 ..... F04D 27/008
FR 2979396 A1 * 3/2013 ..... F04D 29/4226
WO WO-0024353 A1 * 5/2000 ..... A47C 27/083
WO WO-0187121 A2 * 11/2001 ..... F04D 29/602
WO WO-2007106730 A1 * 9/2007 ..... F04D 25/084
WO WO-2019217416 A1 * 11/2019 ..... A47C 27/082

* cited by examiner

*Primary Examiner* — David R Hare
*Assistant Examiner* — Alexis Felix Lopez
(74) *Attorney, Agent, or Firm* — Harness, Dickey & Pierce, P.L.C.

(57) ABSTRACT

An inflatable mattress and pump combination has an inflatable bladder having a sidewall, and a pocket formed in the sidewall. A valve is disposed in the pocket for controlling the flow of air into and out of the bladder. An electric air pump, sized to fit substantially within the pocket, is operable in a forward mode for pumping air onto the inflatable bladder through the valve, and a reverse mode for pumping air out of the inflatable bladder through the valve. A switch with a forward, reverse and neutral positions, allows the user to selectively operating the pump in the forward and reverse modes, the switch opening the valve in the pocket when in its forward and reverse positions.

14 Claims, 8 Drawing Sheets

AIR MATTRESS AND PUMP COMBINATION

CROSS-REFERENCED APPLICATION

This application claims priority to U.S. provisional application Ser. No. 62/897,606 filed on Sep. 9, 2019. The disclosure of the above-referenced application is incorporated herein by reference in its entirety.

FIELD

The present disclosure relates to inflatable air mattresses.

BACKGROUND

This section provides background information related to the present disclosure which is not necessarily prior art.

Inflatable air mattresses are well known and widely used both for temporary and for permanent beds. Inflatable mattresses were initially very simple bladders or envelopes that could be filled with air or some other fluid. Over time the designs of these bladders evolved to include internal structures such as baffles, multiple chambers, and even surface coatings and covers to improve their comfort. Initially inflatable mattresses were inflated (and sometimes deflated) using an external pump that was either temporarily or permanently connected to the mattress. It soon became common to provide an internal pump so that there was not a separate pump that could be lost, and so that the pump did not interfere with using standard bedding on the mattress. However, while providing some convenience, if the internal pump failed, then the entire mattress was unusable. Some efforts were made to provide a removable, inset pump and controller, however, when the pump failed, this still meant that the pump and the controller had to be replaced, rather than just the failed pump.

SUMMARY

This section provides a general summary of the disclosure, and is not a comprehensive disclosure of its full scope or all of its features.

Generally, this disclosure relates to inflatable mattresses and pumps. A preferred embodiment of an inflatable mattress and pump combination comprises an inflatable bladder having a sidewall. There is a pocket formed in the sidewall of the bladder. This pocket has a valve therein for controlling the flow of air into and out of the bladder. An electric air pump, sized to fit substantially within the pocket, is operable in a forward mode for pumping air onto the inflatable bladder, and a reverse mode for pumping air out of the inflatable bladder. The pump has a switch with a forward, reverse and neutral positions, for selectively operating the pump in the forward and reverse modes, the switch opening the valve in the pocket when in the forward and reverse positions.

The pocket preferably comprises a generally rectangular bottom wall and a sidewall defining a 3-D generally rectangular space in the inflatable bladder. The pump preferably has a corresponding d-D generally rectangular shape.

There is preferably a rigid rectangular frame surrounding the opening of the pocket that is sized to receive the pump therein. There is preferably at least one lock, and more preferably at least two locks, on the frame that is operable to engage and secure the pump in the pocket. The lock preferably comprises a pivotally mounted tab, pivotable between an open position in which the tab does not project into the opening of the frame, and a locked position in which the tab projects into the opening of the frame.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
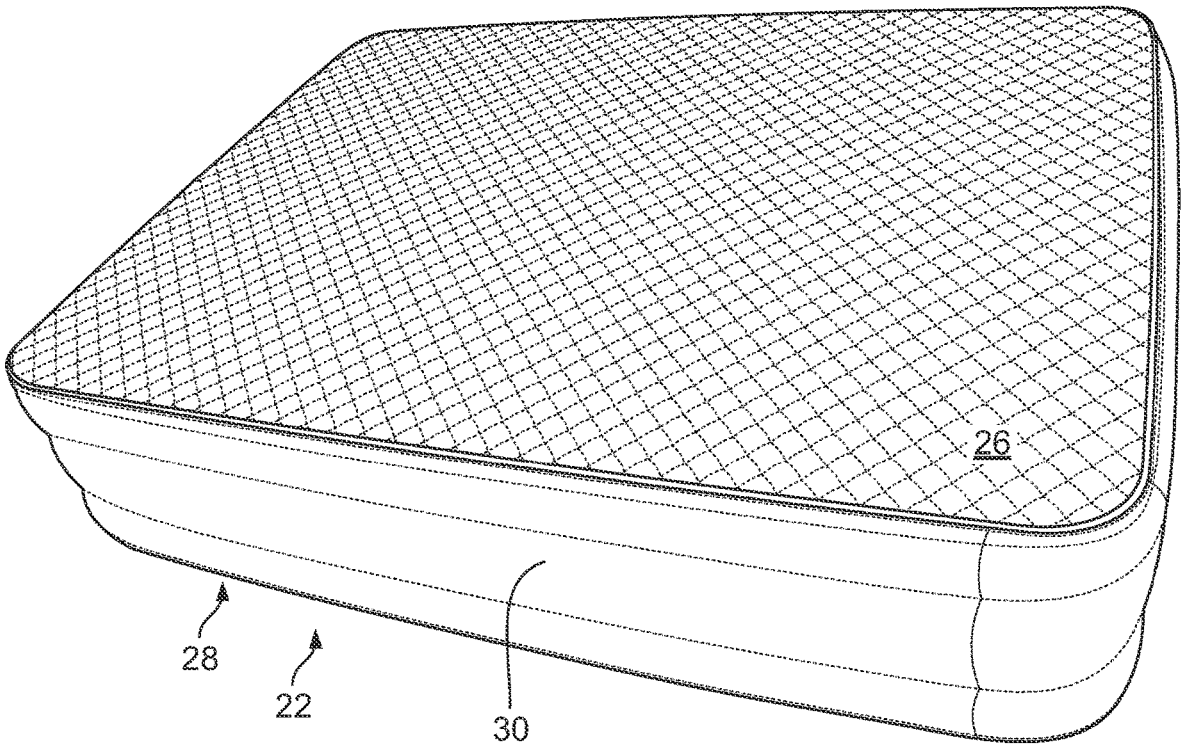
FIG. 1 is a perspective view of an inflatable mattress and pump combination, according to a preferred embodiment of this invention.
Figure 2:
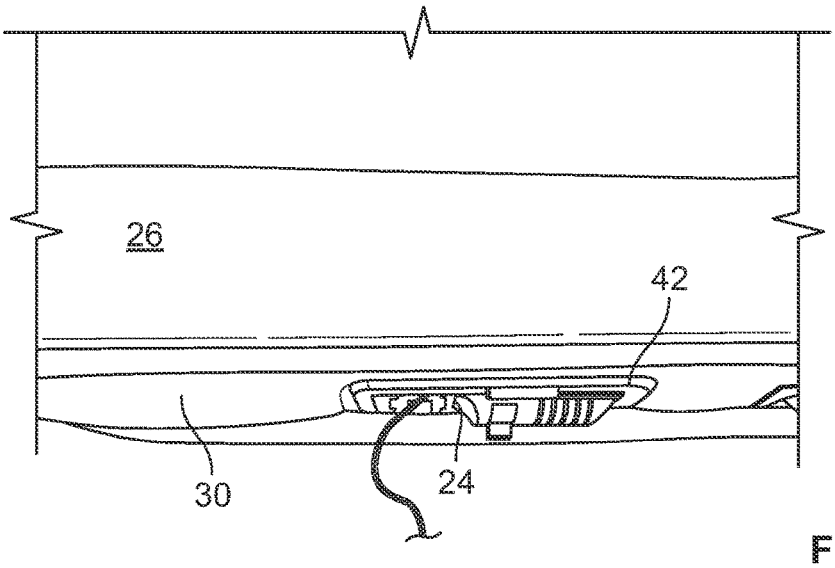
FIG. 2 is a partial top view of the inflatable mattress and pump combination of FIG. 1.
Figure 3:
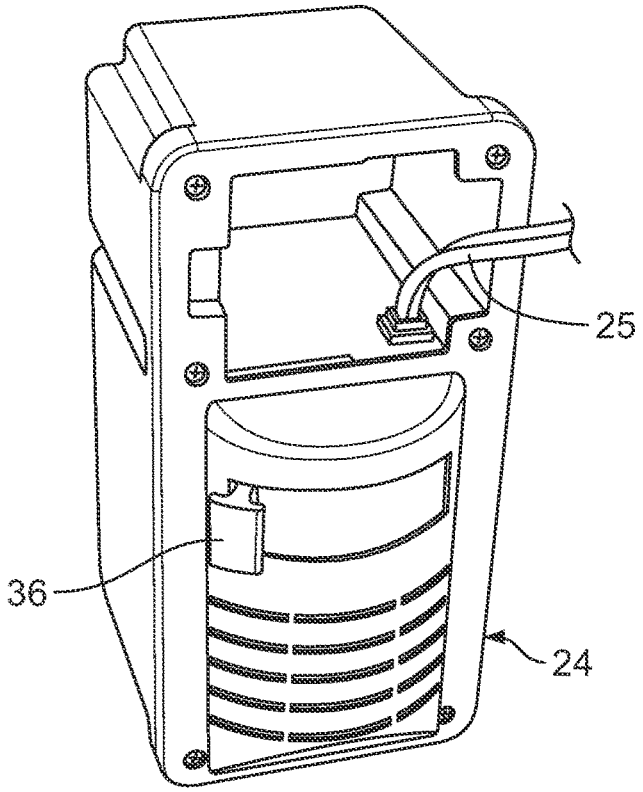
FIG. 3 is a perspective view of the pump in the inflatable mattress and pump combination of FIG. 1.
Figure 4:
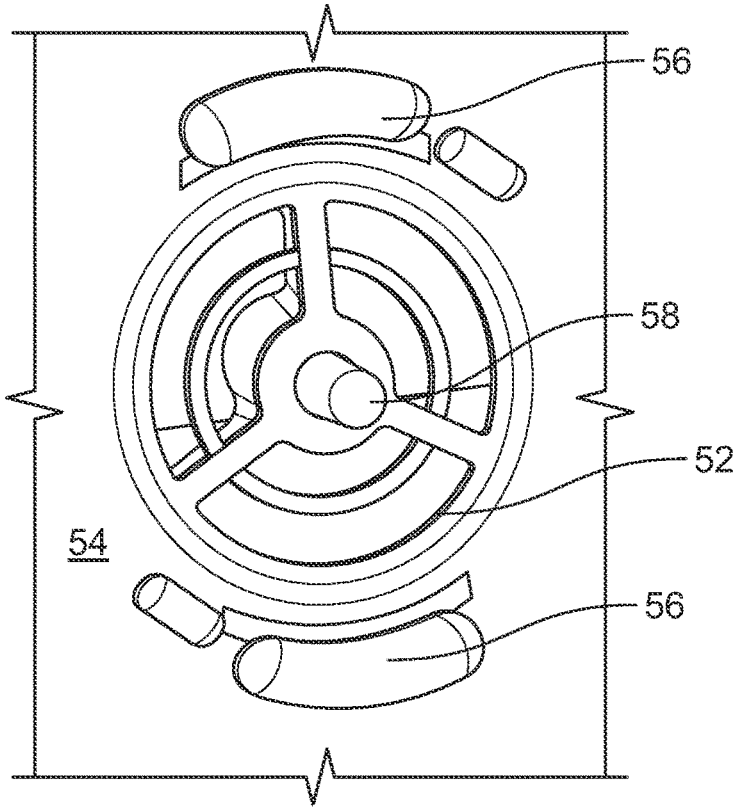
Figure 5:
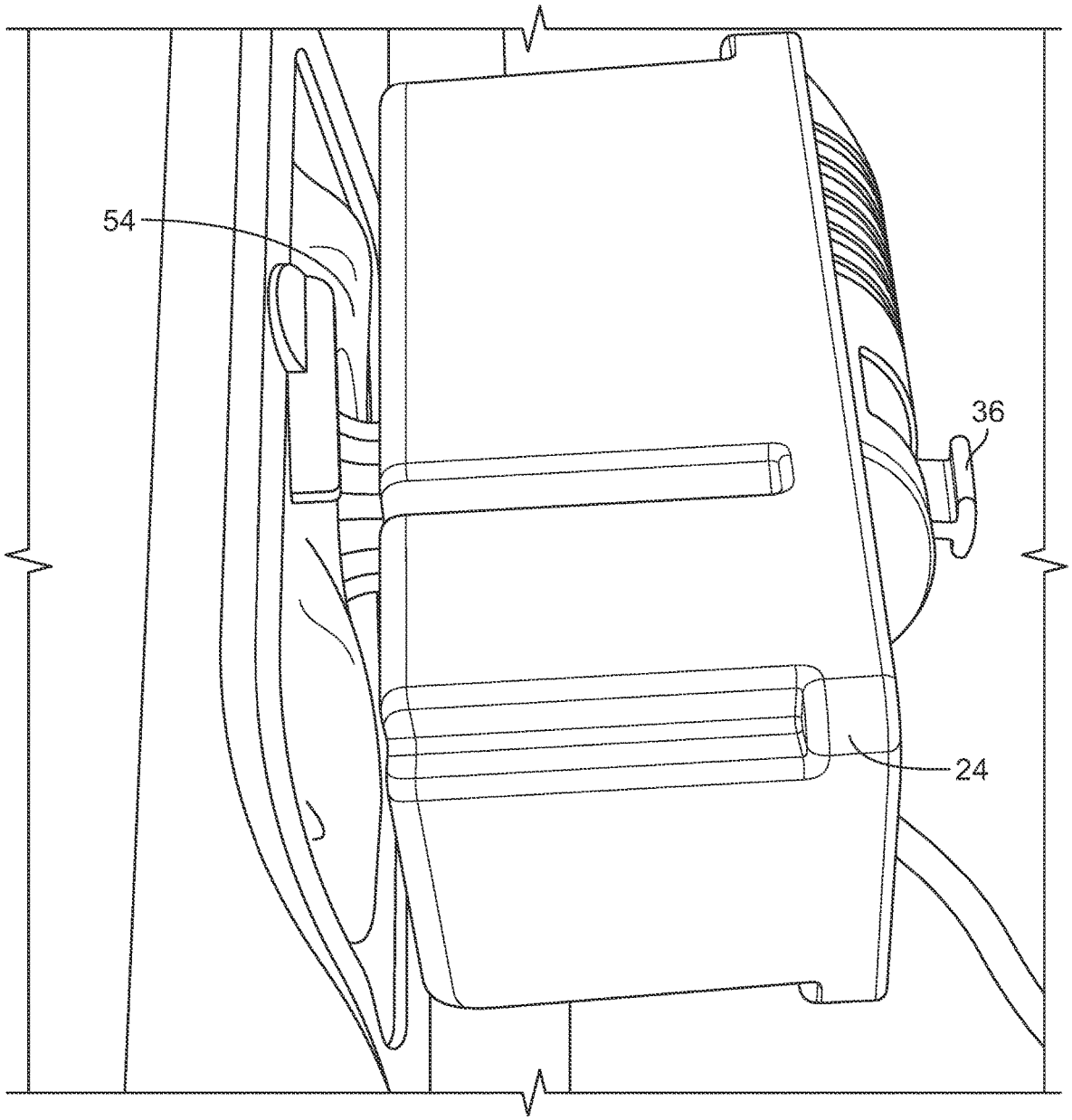
Figure 6A:
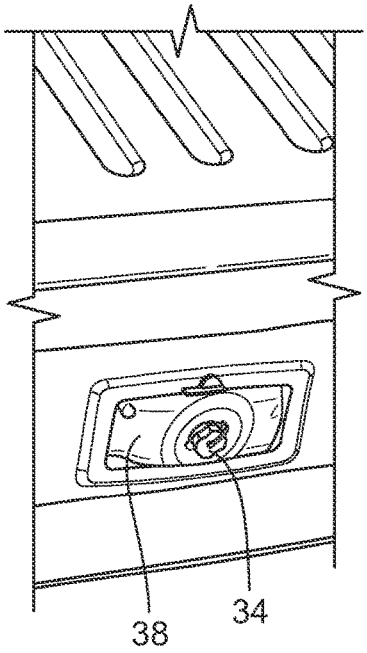
Figure 6B:
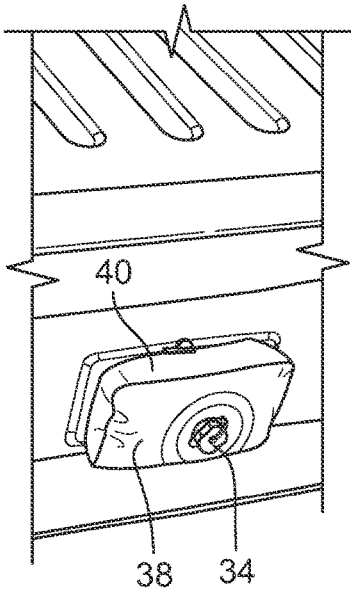
Figure 6C:
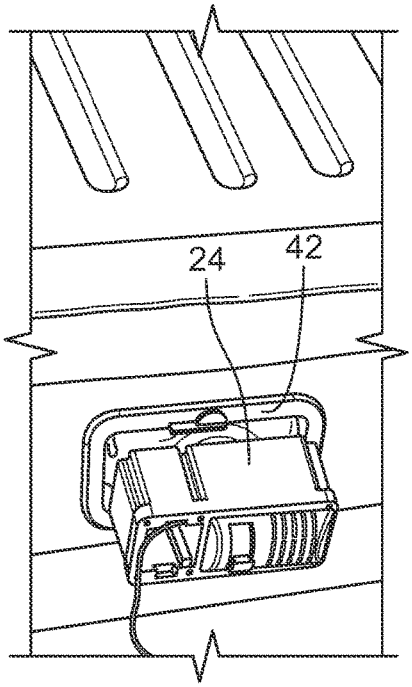
Figure 7:
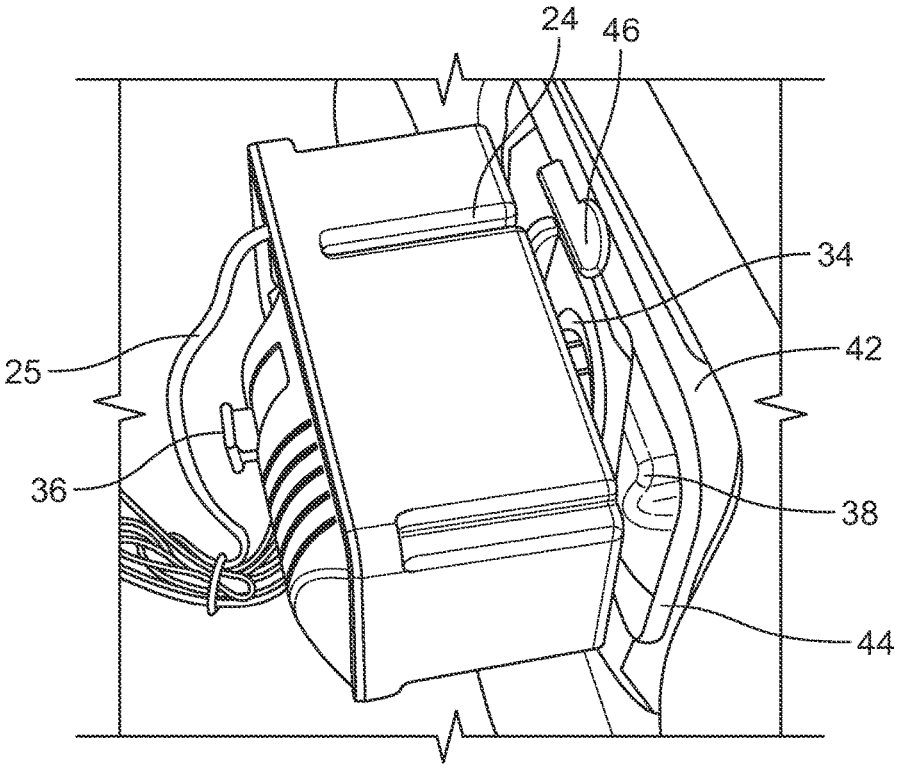
Figure 8:
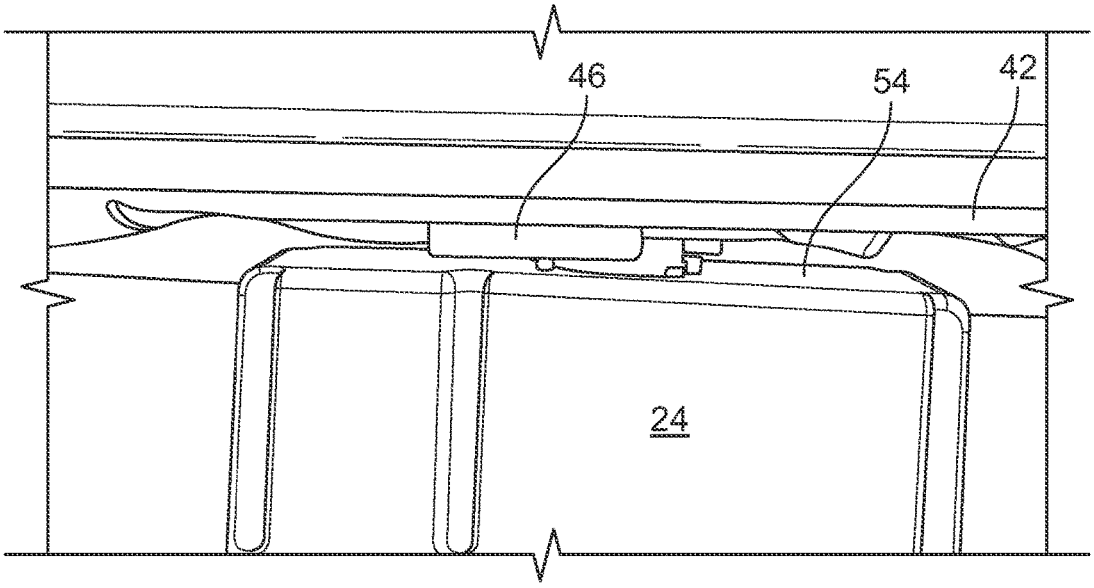
Figure 9:
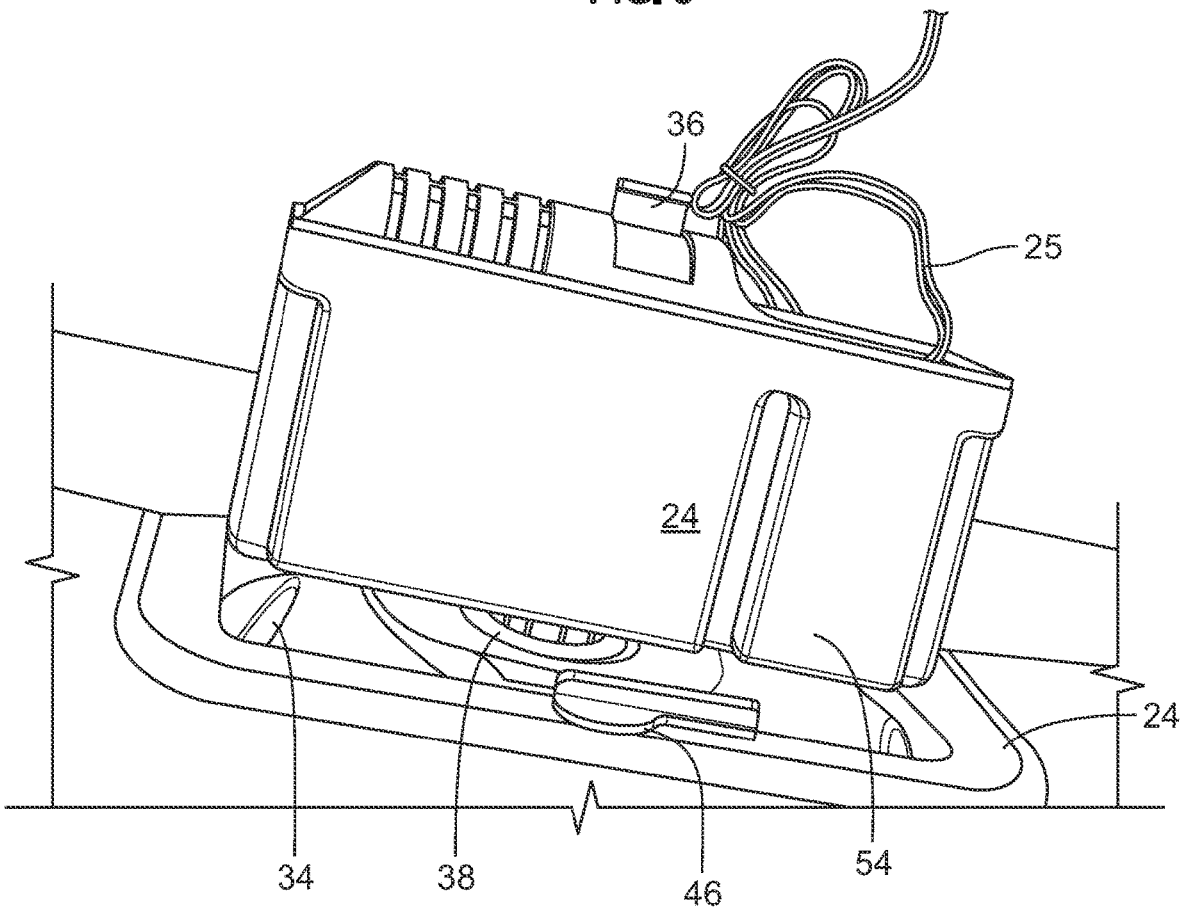
Figure 10:
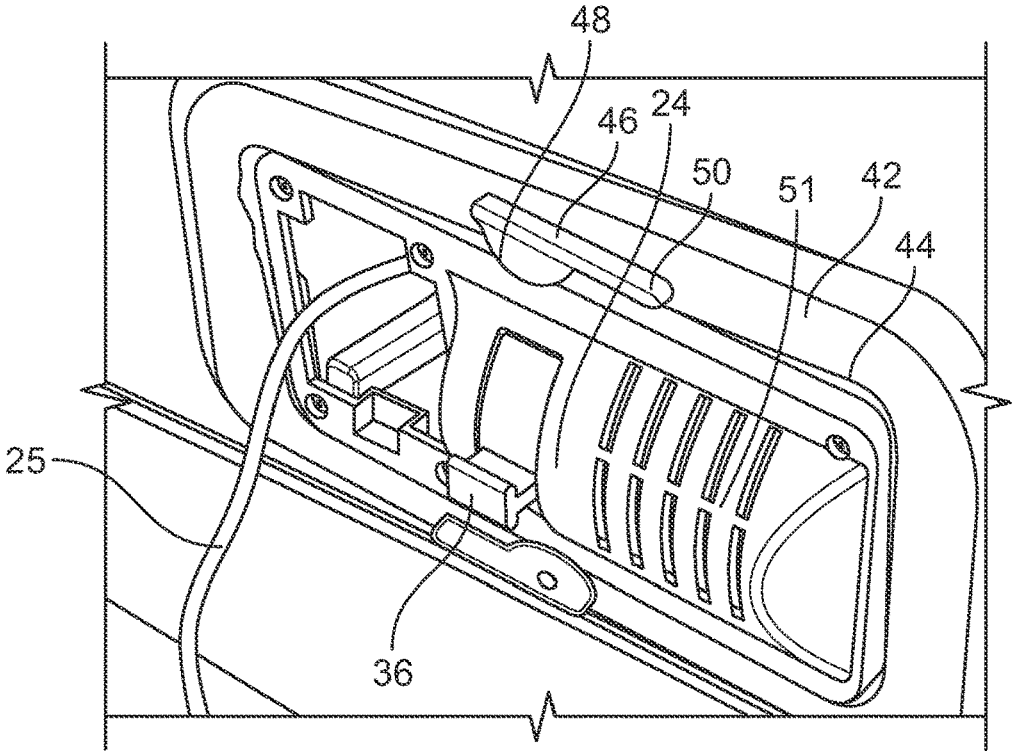
Figure 11:
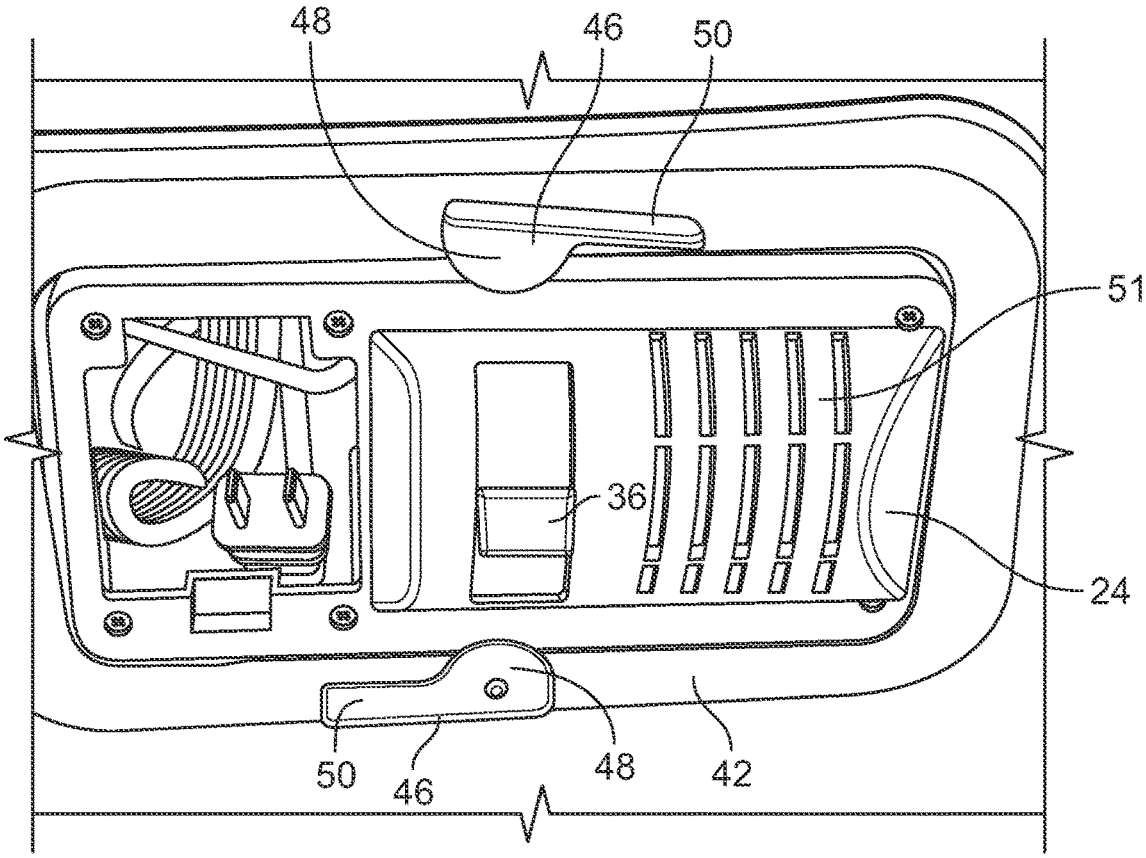
Figure 12:
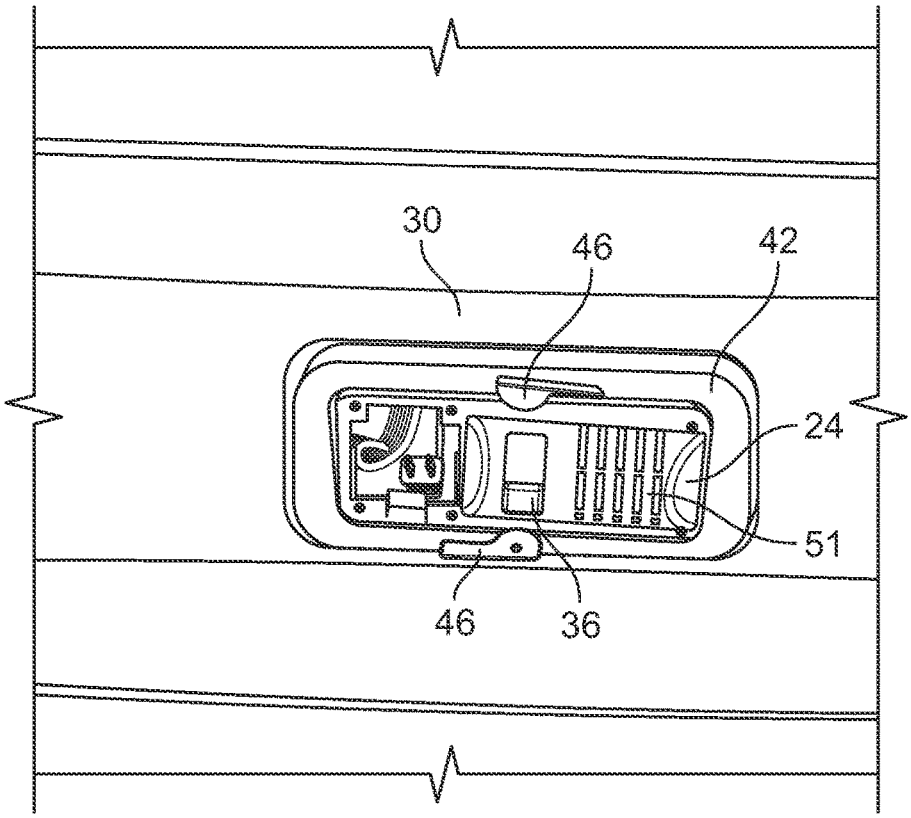
Figure 13:
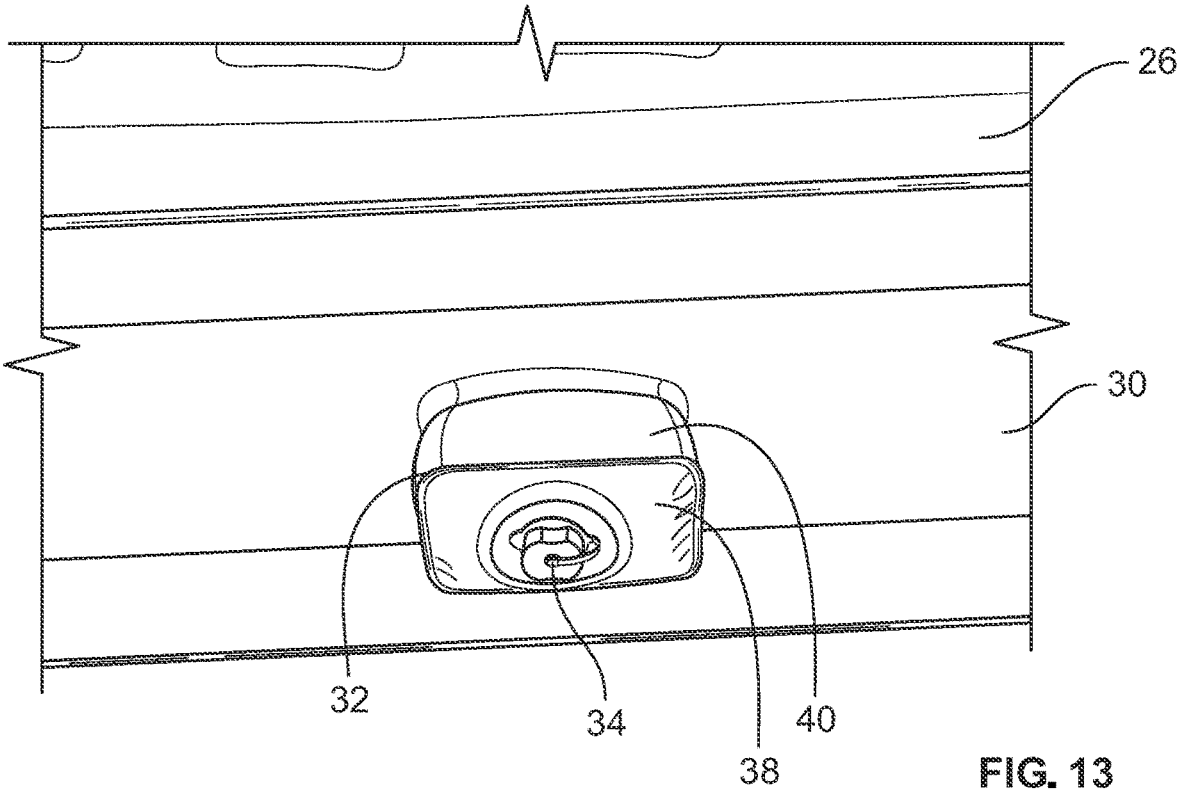
Figure 14:
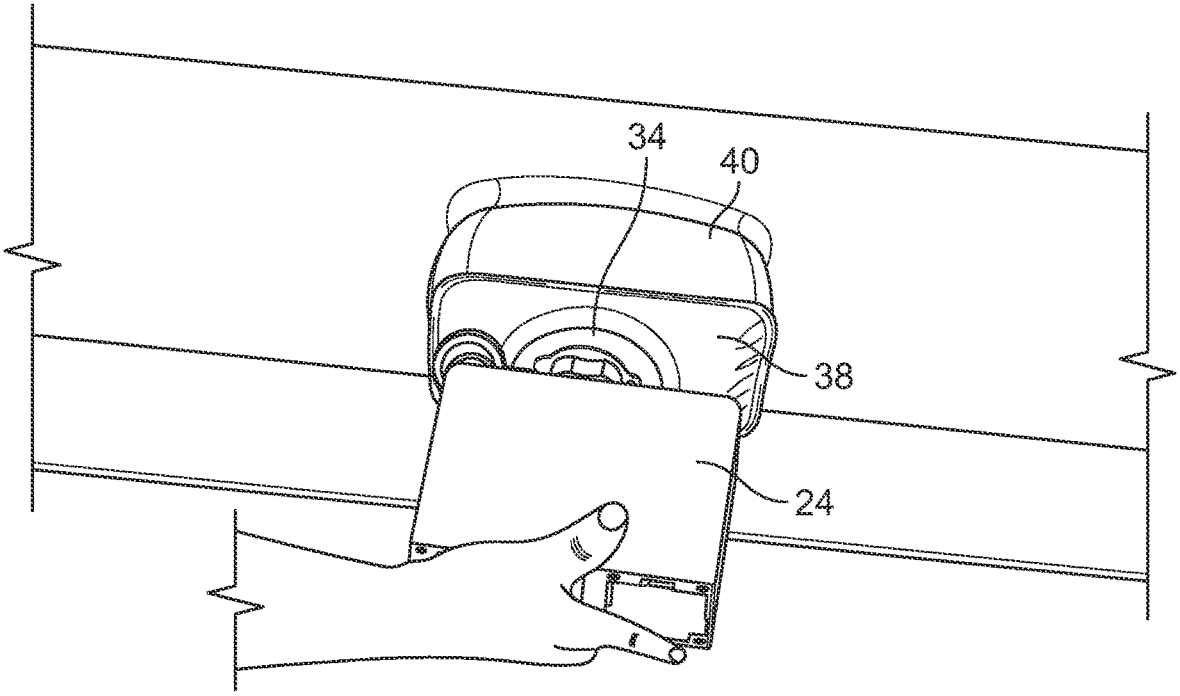

FIG. 4. Is a perspective view of the bottom of the pump, showing the inlet/outlet for engaging the valve in the pocket;

FIG. 5 is a side elevation view of the pump in the inflatable mattress and pump combination of FIG. 1, showing the pump before insertion into the pocket;

FIG. 6A is a partial perspective view of the inflatable mattress and pump combination of FIG. 1, showing the pocket flush with the sidewall;

FIG. 6B is a partial perspective view of the inflatable mattress and pump combination of FIG. 1, showing the pocket protecting from the sidewall;

FIG. 6C is a partial perspective view of the inflatable mattress and pump combination of FIG. 1, showing the pump secured to the valve in the bottom of the pocket, before being inserted into the sidewall;

FIG. 7 is a top perspective view of the inflatable mattress and pump combination of FIG. 6C;

FIG. 8 is a top plan view of the inflatable mattress and pump combination of FIG. 7;

FIG. 9 is a top plan view of the inflatable mattress and pump combination of FIG. 8;

FIG. 10 is a perspective view of the inflatable mattress and pump combination of FIG. 1, showing the pump installed in the pocket, and secured with the locks;

FIG. 11 is a side elevation view of the inflatable mattress and pump combination of FIG. 1, showing the pump installed in the pocket, and secured with the locks;

FIG. 12 is a perspective view of the inflatable mattress and pump combination of FIG. 1, showing the pump installed in the pocket, and secured with locks;

FIG. 13 is a partial perspective view of the inflatable mattress and pump combination of FIG. 1, showing the pocket in projecting from the sidewall; and FIG. 14 is a partial perspective view of the inflatable mattress and pump combination of FIG. 1, showing the pump being installed in the pocket.

Corresponding reference numerals indicate corresponding parts throughout the several views of the drawings.

DETAILED DESCRIPTION

Example embodiments will now be described more fully with reference to the accompanying drawings.

Generally, this disclosure provides an inflatable mattress and pump combination. A preferred embodiment of an inflatable mattress and pump combination is indicated generally as 20 in the Figures. The combination 20 comprises an inflatable bladder 22 and a pump 24.

The inflatable bladder 22 preferably comprises a top surface 26, a bottom surface 28, and a perimeter side wall 30, extending therebetween. There can be internal structures inside the bladder 22, such as baffles (not shown) to stabilize the bladder, and help it keeps is form, as is well known. The top surface 26, bottom surface 28, and sidewall 30, are fluid impermeable, and can constitute one or more plies. These plies can provide additional features and properties, to make the mattress more comfortable, as is well known. There mattress may include multiple bladders or multiple separate chambers to provide different levels of flexibility or firmness, as is known.

In accordance with a preferred embodiment, there is a pocket 32 formed in the sidewall 30 of the bladder 22. This pocket 32 has a valve 34 therein for controlling the flow of air into and out of the bladder 22. The pump 24, which is preferably an electrically powered pump, is sized and shaped to fit substantially within the pocket 32. The pump 24 can have a power cord 25 or it can be battery operated, or both. The pump 24 is operable in a forward mode for pumping air onto the inflatable bladder 22, and a reverse mode for pumping air out of the inflatable bladder. The pump 24 has an inlet/outlet 51 on its top face, and an inlet/out 52 in its bottom surface 54. When pumping air into the bladder, the pump draws air into inlet/outlet 51, and pushes it out inlet/outlet 52 to supply air to the bladder 22. When pumping air out of the bladder, the pump draws air into inlet/outlet 52, and pushes it out inlet/outlet 51 to remove air from the bladder 22. At least one, and in this preferred embodiment two, connectors 56 are disposed on the bottom surface 54 of the pump 24, adjacent the inlet/outlet 52.

The pump 24 has a switch 36 with a forward, reverse and neutral positions, for selectively operating the pump in the forward and reverse modes. The switch 36 is further configured to open the valve 34 in the pocket 32 when the switch in in its forward and reverse positions, but leave the valve closed when the switch is in its neutral position. In this preferred embodiment the switch 36 operates member 58 extending through the inlet/outlet 52 which opens the valve 34 when the switch is in the forward and reverse positions, but which leaves the valve closed when in the neutral position. Because the valve 34 controls the flow of air into and out of the bladder 22, the pump 24 can be removed from the bladder without causing the bladder to deflate.

Instead of or in addition to the switch 36, the pump can have an auto-stop function that shuts off the pump based upon one or more pre-set pressure settings. The pressure settings can be set by a user for example with a control with pressure settings identified to the user by numbers or word codes, for example "soft," "medium," "firm," and "extra firm." Once the pump stops, the valve 34 can be allowed to close to prevent pressure loss from the bladder through the pump.

The pocket 32 preferably comprises a generally rectangular bottom wall 38 and a sidewall 40 defining a 3-D generally rectangular prismatic space in the inflatable bladder. The pump 24 preferably has a corresponding 3-D generally rectangular shape to fit snugly in the pocket. The pocket 32 is preferably so that it can invert "inside out" so that the pocket is external to the profile of the mattress to facilitate attaching or detaching the pump we from the valve 34 on the bottom of the pocket.

There is preferably a rigid rectangular frame 42 surrounding the opening of the pocket 32 in the sidewall 30 of the bladder. The frame 42 has a rectangular opening 44 therein, defining the opening of the pocket 32, and this opening is sized to allow the pump 24 to be inserted into and removed from the pocket 32. There is preferably at least one lock 46, and more preferably at least two locks, on the frame 42, that are operable to engage and secure the pump 24 in the pocket 32, with the outlet of the pump aligned with the valve 34 in the pocket. The lock preferably comprises a pivotally mounted tab 48, pivotable between an open position in which the tab does not project into the opening 44 of the frame 42, and a locked position in which the tab 44 projects into the opening of the frame 42. The lock can include a handle 46 for operating the lock to selectively secure the pump 24 in the pocket 32 in communication with the valve 34.

The pump can include a light, preferably an LED light that can be operated by the user, or which can turn on in response to motion or changes in pressure in the bladder that indicate someone is getting on or off the mattress, or some other sensed event. The pump 24 can also have a USB port and/or other connectors to provide for remote operation of the pump and for charging personal electronic devices.

In the event that the pump should fail, it is a simple matter of opening the locks 46 and removing and replacing the pump 24, and only the pump 24. The bladder 24 can continue to be used, and likewise the valve 34, a relatively expensive component that controls the flow of air into and out of the bladder can continue to be used without replacement.

In some preferred embodiments the switch 36 rotates the pump simultaneously turning on the pump and operating the valve 34. When the switch 36 is in the forward position, the pump is oriented to draws air into inlet/outlet 51, and pushes it out inlet/outlet 52 through the valve 34 to supply air to the bladder 22. When the switch 36 is in the reverse position, the pump is oriented to draw air through valve 34 into inlet/outlet 51, and pushes it out inlet/outlet 52.

The pump is preferably disposed substantially within profile of the mattress, so that it can be used with standard bedding. As shown in the Figures, the pocket 32 is formed in the sidewall 30, so that when the pump is in the pocket, just one side of the pump is exposed to the exterior of the mattress. However in other embodiments the pocket can be positioned at a corner of the sidewall, or at a corner of the sidewall and the edge of the bottom, so that the pump is exposed on two, or even three sides, yet still remains substantially within the profile of the mattress.

Operation

In operation, the pump 24 is engaged to the valve 34 in the bottom of the pocket 32. The pocket 32 can be "turned inside out" to extend from the sidewall to facilitate the installation of the pump. The connectors 56 engage the valve. Then, as shown in the figures, the pump and pocket can be pushed into the bladder, so that only a portion of the pump protruded from the profile of the bladder, and securing the pump with the locks 46. The bladder can be inflated by operating the switch 36 to the forward position, which turns the pump on to fill the bladder, and opens the valve so that air can pass from the inlet/outlet of the pump into the bladder. When the bladder is full, the switch 36 can be operated to the neutral position to turn off the pump, and allow the valve to close. When it is desired to deflate the mattress, the switch 36 can be operated to the reverse position, which turns the pump on to empty the bladder, and opens the valve so that air can pass from the valve into the inlet/outet of the pump and then out to the atmosphere.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An inflatable mattress and pump combination, comprising:

an inflatable bladder having a sidewall;

a pocket formed in the sidewall of the bladder, the pocket having a generally rectangular bottom wall, and sidewall defining a 3-D generally rectangular space in the inflatable bladder, and a valve therein for controlling the flow of air into and out of the bladder;

an electric air pump having a 3-D generally rectangular shape corresponding to the pocket, sized to fit substantially within the pocket, the pump operable in a forward mode for pumping air onto the inflatable bladder, and a reverse mode for pumping air out of the inflatable bladder, having a switch with a forward, reverse and neutral positions, for selectively operating the pump in the forward and reverse modes, the switch opening the valve in the pocket when in the forward and reverse positions;

a rigid rectangular frame surrounding the opening of the pocket, sized to receive the pump therein, and at least one lock on the frame operable to engage and secure the pump in the pocket, the at least one lock comprising a pivotally mounted tab, pivotable between an open position in which the tab does not project into the opening of the frame, and a locked position in which the tab projects into the opening of the frame.

2. The inflatable mattress and pump combination according to claim 1 wherein there are at least two locks on the rectangular frame.

3. The inflatable mattress and pump combination according to claim 1 wherein the pump is removeable from the inflated mattress without causing the mattress to deflate.

4. The inflatable mattress and pump combination according to claim 1 wherein the pump has an auto-stop function(s) based upon a pre-set PSI setting(s).

5. The inflatable mattress and pump combination according to claim 1 wherein the pump has an LED light.

6. The inflatable mattress and pump combination according to claim 1 wherein the pump has an USB port.

7. An inflatable mattress and pump combination, comprising:

an inflatable bladder having a sidewall;

a pocket formed in the sidewall of the bladder, the pocket having a valve therein for controlling the flow of air into and out of the bladder;

an electric air pump sized to fit substantially within the pocket, the pump operable in a forward mode for pumping air onto the inflatable bladder, and a reverse mode for pumping air out of the inflatable bladder, having a switch with a forward, reverse and neutral positions, for selectively operating the pump in the forward and reverse modes, the switch opening the valve in the pocket when in the forward and reverse positions, wherein the pump pocket is flexible such that it can invert so that the pocket is external to the profile of the mattress for ease of attaching or detaching the pump from the valve.

8. The inflatable mattress and pump combination according to claim 7 wherein the pocket comprises a generally rectangular bottom wall, and sidewall defining a 3-D generally rectangular space in the inflatable bladder, and wherein the pump has a corresponding 3-D generally rectangular shape.

9. The inflatable mattress and pump combination according to claim 8 further comprising a rigid rectangular frame surrounding the opening of the pocket, sized to receive the pump therein, and at least one lock on the frame operable to engage and secure the pump in the pocket.

10. The inflatable mattress and pump combination according to claim 9 wherein there are at least two locks on the rectangular frame.

11. The inflatable mattress and pump combination according to claim 9 wherein the lock comprises a pivotally mounted tab, pivotable between an open position in which the tab does not project into the opening of the frame, and a locked position in which the tab projects into the opening of the frame.

12. The inflatable mattress and pump combination according to claim 7 wherein the bladder has a single inlet/outlet valve in the pocket.

13. The inflatable mattress and pump combination according to claim 7 wherein the pump is manually rotated by the switch to facilitate inflation and deflation.

14. The inflatable mattress and pump combination according to claim 7 wherein the pump may be placed substantially within, partially within or completely outside the mattress profile.

* * * * *